United States Patent [19]

Tassen et al.

[11] Patent Number: 4,762,681

[45] Date of Patent: Aug. 9, 1988

[54] CARBURIZATION RESISTANT ALLOY

[75] Inventors: Curtis S. Tassen; Gaylord D. Smith, both of Huntington, W. Va.

[73] Assignee: Inco Alloys International, Inc., Huntington, W. Va.

[21] Appl. No.: 934,261

[22] Filed: Nov. 24, 1986

[51] Int. Cl.[4] ..... C22C 19/05

[52] U.S. Cl. ..... 420/443; 148/410; 148/428; 420/445

[58] Field of Search ..... 420/443, 445; 148/410, 148/428

[56] References Cited

U.S. PATENT DOCUMENTS 4,388,125 6/1983 Benn ..... 420/443

*Primary Examiner*—R. Dean

*Attorney, Agent, or Firm*—Raymond J. Kenny; Francis J. Mulligan, Jr.

[57] ABSTRACT

A carburization-resistant alloy comprising in weight percent about 50 to about 55% nickel, about 16 to 22% chromium, about 3 to about 4.5% aluminum, up to about 5% cobalt, up to about 5% molybdenum, up to about 2% tungsten, about 0.03 to about 0.3% carbon, up to about 0.2% rare earth element, balance essentially iron. The alloy is useful for structures, objects, parts etc. which are exposed in use to carburizing atmospheres and which, periodically are subjected to oxidizing atmospheres. For example the alloys are useful for pyrolysis tubes used in the petrochemical industry which must periodically be subjected to oxidizing atmospheres to burn-out carbon deposits and which, during pyrolysis are in contact with atmospheres having log $Po_2$ spanning at least the range of −17 to −26 and which exist at various temperatures.

13 Claims, No Drawings

CARBURIZATION RESISTANT ALLOY

The present invention is concerned with carburization-resistant alloys and particularly with heat-resistant and carburization-resistant alloys which can withstand periodic exposure to hot oxidizing media and which are resistant to carburization even in atmospheres having a broad range of partial pressure of oxygen, e.g. atmospheres having a log $Po_2$ from 1.0E-10 to 1.0E-30.

The invention also relates to all articles, parts or products constituted by the said heat and carburization-resistant alloys. It relates, moreover, to a method of obtaining articles, products or parts possessing very-high resistance to carburization and periodic oxidation based on the use of the the said alloys.

BACKGROUND OF THE INVENTION

Alloys are known which offer good resistance to carburization by carburizing agents even to temperatures of the order of 1000° C. Such alloys, however, do not possess all the characteristics required for certain applications. For example, such applications include the structural elements used in installations intended for very-high-temperature processing in oxidizing and/or carburizing mediums, for example the tube or pipe stills employed in petrochemical plants. Some of such characteristics are, on the one hand, creep strength within various temperature ranges including very-high temperatures, and on the other weldability. Furthermore, at least one alloy which has good resistance to carburization in atmospheres having an extremely low partial pressures of oxygen contains relatively high amounts of cobalt and molybdenum. Thus the alloy is at the same time relatively expensive, sensitive to vagaries in the supply of cobalt and possibly subject to catastrophic oxidation owing to the high molybdneum content.

More specifically, an important requirement of equipment such as pyrolysis tubes in petrochemical plants is that the alloy from which such equipment is made must form a scale under specific conditions of use which is resistant to spalling or degradation when the conditions of use are altered. For example pyrolysis tubes must be cleaned periodically to remove deposited carbon. The cleaning is most readily accomplished by increasing the oxygen partial pressure of the atmosphere within the tubes to effect one or more of the reactions $$2C+O_2 \rightleftharpoons 2CO$$

$$2CO+O_2 \rightleftharpoons 2CO_2$$

$$C+O_2 \rightleftharpoons CO_2$$

all of which result in changing a solid carbon deposit into a gas. Those skilled in the art will appreciate that the foregoing reactions are overly simplified in that "Carbon" deposits are almost never pure carbon but rather are complex, solid materials containing carbon and hydrogen and, usually, significant amounts of nitrogen, oxygen, phosphorous, and other elements present in the feedstock of the pyrolysis unit. Those skilled in the art will thus appreciate that the gas phase in a pyrolysis unit during burnout is a complex mixture of the product gases indicated in the forgoing equations and materials such as water vapor, nitrogen and nitrogenous gases and the like. A further factor which will be appreciated by those skilled in the art is that the latter two of the foregoing three equations are strongly exothermic when proceeding to the right. This exothermicity is further enhanced by the hydrogen content of the "carbon" deposits in pyrolysis tubes. Thus, although it is standard practice to control the oxygen partial pressure during carbon burnout of pyrolysis tubes in order to prevent runaway temperatures, variation in the character of the "carbon" deposit can result in the "hot spots", i.e., sites hotter than average, and "cold spots" i.e., sites cooler than average, during carbon burnout. Aside from considerations involved in the oxygen partial pressure during carbon burnout, there is a great range of oxygen partial pressures which can be expected in service in uses such as heat treating, coal conversion, steamhydrocarbon reforming and olefin production. For greatest practical use, an alloy should have carburization resistance not only in atmospheres where the partial pressure of oxygen favors chromia formation but also in atmospheres which are reducing to chromia and favor formation of $Cr_7C_3$. In pyrolysis furnances, for example, where the process is a non-equilibrium one, at one moment the atmosphere might have a log of $Po_2$ (atm) of $-19$ and at another moment the log of $Po_2$ (atm) might be $-23$ or so. Such variable conditions, given that the $Po_2$ (atm) of $Cr_7C_3$—$Cr_2O_3$ crossover is about $-20$ at 1000° C., require an alloy which is a universal carburization resistant alloy. Provision of such an alloy and objects made therefrom are the objects of the present invention.

A still further requirement for alloy to be of practical use is that the alloys be readily weldable by standard welding techniques, for example by gas tungsten arc (GTA), metal inert gas (MIG) and submerged are (SA) methods. Such weldability is essential. Unless equipment can be readily fabricated from standard shapes of alloys, all other alloy characteristics are of merely academic nature.

BRIEF DESCRIPTION OF THE INVENTION

The present invention contemplates alloys and carburization-and oxidation-resistant parts and structures made therefrom which alloys are in the range comprising in percent by weight about 50–55% nickel, about 16–22% chromium about 3–4.5% aluminum, up to, i.e., 0 to 5% cobalt, up to i.e., 0 to about 5% molybdenum, up to i.e., 0 to 2% tungsten, about 0.03–0.3% carbon, balance essentially iron except for normal amount of incidental elements e.g., up to 1% silicon, up to 1% manganese, up to 0.2% total of rare earth metal such as cerium, lanthanum or mischmetal, up to 0.1% boron, up to 0.5% zirconium and up to 0.05% nitrogen. For purposes of this specification and claims, the term "rare earth" is employed to include all the lanthanide and actinide elements as well as the associated elements scandium and yttrium. Impurity elements such as sulfur, phosphorous and the like should be maintained at the lowest practical level as is customary practice in high temperature alloy technology. It is advantageous for the alloy of the invention to contain tungsten in an amount between about 1 and 2% and/or molybdenum in amount up to about 3% by weight. When molybdenum is present, it is advantageously present in an amount of about 2–3% by weight. It is also advantageous for the alloy of the invention to be devoid of cobalt or contain cobalt only in an amount up to about 2%.

GENERAL DESCRIPTION OF THE INVENTION AND EXAMPLES

The alloys of the present invention are generally made by normal technique adaptable to nickel-chromium base alloys, i.e., by melting, casting and working e.g., hot working and or hot working and cold working to standard engineering shapes, e.g., rod, bar, sheet, plate, etc. The alloys having the compositions in percent weight as set forth in Table I were produced by vacuum induction melting and then were cast and generally hot rolled at about 1090°-1100° C. (i.e., 2000° F.) to about 1.4 cm rod.

TABLE I

| Alloy No. | C | Ni | Cr | Al | Mo | Co | W | Fe | Si | Mn | Ce |
|---|---|---|---|---|---|---|---|---|---|---|---|
| 1 | 0.06 | 52.1 | 18.6 | 3.8 | 2.5 | 3.2 | 1.4 | Bal | 0.5 | 0.1 | — |
| 2 | 0.09 | 52.4 | 18.6 | 3.5 | 2.4 | 3.2 | 1.5 | Bal | 0.5 | 0.02 | — |
| 3 | 0.14 | 52.5 | 18.8 | 3.5 | 2.4 | 3.3 | 1.2 | Bal | 0.6 | 0.03 | — |
| 4 | 0.19 | 52.5 | 18.0 | 3.5 | 2.4 | 3.3 | 1.5 | Bal | 0.6 | 0.02 | — |
| 5 | 0.11 | 54.4 | 18.8 | 3.5 | — | — | 1.4 | Bal | 0.5 | 0.05 | — |
| 6 | 0.11 | 53.9 | 19.0 | 3.5 | — | 3.2 | 1.5 | Bal | 0.5 | 0.05 | 0.02 |

Although melting, casting and working are the most generally accepted techniques for producing objects and shapes from alloys of the present invention, the alloys can be made by other methods. For example, alloy powder can be made by elemental powder and/or master alloy powder blending or mechanical alloying. Such powder can also be made by melting the alloying ingredients and atomizing (e., gas atomizing) the molten alloy or carrying out any of the techniques of rapid solidification such as thin ribbon casting on chilled rolls or centrifugal arc melting and chilling. Powder thus produced can be formed into alloy objects (including composite alloy objects) by conventional techniques such as hot isostatic pressing, mold pressing, slip casting, powder rolling etc. to near net shape followed, if necessary, by sintering and hot or cold working. The alloy can also be cast to shape by any conventional or non-conventional casting techniques.

After the alloys as set forth in Table I were melted, cast and hot rolled, they were formed into tensile specimens which were annealed for four hours at about 1230°-1240° C. (2250° F.) and then air cooled. Parallel specimens were annealed, air cooled and then aged in air for 500 hours at about 760° C. (1400° F.) and then air cooled. Suitable annealing temperatures lie in the range of about 1200° C. to 1270° C. with times ranging from about 1 to about 8 hours, longer times being used at lower temperatures and vice versa. Aging can be carried out at temperatures in the range of about 650° C. to 800° C. for various times up to about 1000 hours at about 650° C. to 20 hours at about 800° C. Table II shows that with aging at 760° C. for 500 hours room temperature characteristics of the alloys change in the direction of high strength and lower ductility but not to an extent which would make the alloys brittle.

TABLE II

| Alloy No. | Condition* | Hardness** | 0.2% YS (MPa) | U.T.S. (MPa) | Elong. (%) | RA (%) |
|---|---|---|---|---|---|---|
| 2 | A | B88 | 370 | 778 | 55.0 | 51.3 |
| 2 | B | C25 | 578 | 1038 | 21.4 | 25.2 |
| 3 | A | B99 | 516 | 948 | 35.0 | 42.1 |
| 3 | B | C27 | 607 | 1058 | 22.8 | 29.4 |
| 4 | A | B100 | 499 | 963 | 35.0 | 42.3 |
| 4 | B | C28 | 610 | 1063 | 23.5 | 32.8 |
| 5 | A | B97 | 473 | 927 | 40.0 | 47.8 |
| 5 | B | C25 | 580 | 1043 | 26.4 | 39.4 |
| 6 | A | B95 | 449 | 895 | 41.4 | 47.1 |

TABLE II-continued

| Alloy No. | Condition* | Hardness** | 0.2% YS (MPa) | U.T.S. (MPa) | Elong. (%) | RA (%) |
|---|---|---|---|---|---|---|
| 6 | B | C24 | 470 | 1040 | 23.5 | 37.3 |
| 1 | A | — | 308 | 651 | 86.2 | 55.0 |
| 1 | B | — | 623 | 983 | 19.8 | 23.0 |

*Condition A = Hot Rolled at 1094° C. plus 4 h/1232° C./Air Cool
Condition B = Same as Condition A plus Age for 500 h/760° C./Air Cool
**Rockwell Scale - B or C as indicated In addition to what was stated hereinbefore, Table II, in conjunction with Table I shows that cobalt is not essential for the alloy but when present in an amount up to about 5% does not embrittle the alloy. Also Tables I and II, in conjunction, show that molybdenum can be omitted from the alloys of the present invention without detriment.

Table III sets forth data showing the results of stress rupture tests carried out at 982° C. (1800° F.) and 1094° C. (2000° F.). This data shows that both the hot rolled and annealed and hot rolled, annealed and aged alloys of Table I exhibit satisfactory mechanical characteristics at these temperatures which are typical of temperatures at which carburization-resistant alloys are used.

TABLE III

| Alloy No. | Condition* | Temp. (°C.) | Stress (MPa) | Life (h) | El. (%) | RA (%) |
|---|---|---|---|---|---|---|
| 2 | A | 982 | 31 | 47.2 | 34.4 | 27.5 |
| | B | 982 | 31 | 91.4 | 37.0 | 29.4 |
| | A | 1094 | 17.2 | 33.8 | 52.3 | 40.1 |
| | B | 1094 | 17.2 | 23.3 | 52.2 | 52.8 |
| 3 | A | 982 | 31 | 29.3 | 40.5 | 35.5 |
| | B | 982 | 31 | 25.3 | 44.6 | 42.7 |
| | A | 1094 | 17.2 | 14.9 | 52.7 | 59.4 |
| | B | 1094 | 17.2 | 13.7 | 52.1 | 57.4 |
| 4 | A | 982 | 31 | 41.1 | 39.0 | 31.3 |
| | B | 982 | 31 | 24.9 | 15.5 | 41.4 |
| | A | 1094 | 17.2 | 11.4 | 46.5 | 46.7 |
| | B | 1094 | 17.2 | 9.5 | 51.8 | 46.0 |
| 5 | A | 982 | 31 | 29.2 | 29.3 | 41.8 |
| | B | 982 | 31 | 23.5 | 40.0 | 30.1 |
| | A | 1094 | 17.2 | 19.5 | 64.6 | 80.8 |
| | B | 1094 | 17.2 | 14.7 | 50.4 | 48.3 |
| 6 | A | 982 | 31 | 43.7 | 60.2 | 68.0 |
| | B | 982 | 31 | 61.7 | 91.0 | 68.0 |
| | A | 1094 | 17.2 | 25.3 | 61.5 | 42.7 |
| | B | 1094 | 17.2 | 9.6 | 44.8 | 39.3 |

*Same definition as in Table II.

Resistance to damage at high temperatures in carburizing atmospheres is an advantageous characteristic of the alloys of the invention and is evidenced by the data in Table IV.

TABLE IV

| Mass Gain ($g/m^2$) After Ten 24 h Test Cycles | | | |
|---|---|---|---|
| | | CO Volume % in Test Atmosphere* | |
| Alloy No. | Temp. °C. | 8 | 0.1 |
| 1 | 1000 | 31.8 | 11.2 |
| 2 | 1000 | 59.6 | 39.7 |
| 3 | 1000 | 50.7 | 40.1 |
| 4 | 1000 | 64.8 | 43.4 |
| 5 | 1000 | 1.7 | 15.6 |

TABLE IV-continued

| Mass Gain ($g/m^2$) After Ten 24 h Test Cycles | | | |
|---|---|---|---|
| | | CO Volume % in Test Atmosphere* | |
| Alloy No. | Temp. °C. | 8 | 0.1 |
| 6 | 1000 | 1.9 | 12.0 |

*The Test atmosphere containing 8% CO is a catalytically reacted mixture of 12 volume % methane, 10 volume % water vapor balance hydrogen to form an equilibrium mixture having a carbon activity ($A_C$) of about 1 and a negative log of the partial pressure of oxygen of about 20.6. The test atmosphere containing 0.1% CO is a similarly reacted mixture of 99.9 volume % hydrogen volume 1% decanol giving again an $A_C$ of about 1 and negative log of oxygen partial pressure of 24.4. Generally the alloys of the invention are useful in atmospheres having an $A_C$ of 0.01 to 1 and atmospheres having a $Po_2$ of about 1.0E-2 to 1.0E-30.

The data in Table IV shows that the alloys of the present invention have a wide window of resistance to carburization even to atmospheres where the partial pressure of oxygen is practically non-existant. In this regard the alloys of the present invention are substantially equivalent in characteristics to much more expensive alloys which do not have adequate resistance to both carburizing atmospheres and exposure at periodic intervals to oxidizing atmospheres. To demonstrate the resistance of alloys to the present invention to the detrimental effects of oxidizing atmospheres, samples of the alloys were exposed to air containing 5 volume % water vapor at high temperatures. Mass changes were measured at the end of 240 hours. Resultant data is set forth in Table V along with equivalent data with respect to a well known, commercially available alloy.

TABLE V

| Mass Change at Temperature after 240 h in Air plus 5% $H_2O$ Vapor | | |
|---|---|---|
| Alloy No. | 1000° C. ($g/m^2$) | 1100° C. ($g/m^2$) |
| 1 | −36.3 | −55.6 |
| 2 | 4.0 | −28.2 |
| 3 | 16.4 | −23.5 |
| 4 | 17.9 | −20.8 |
| 5 | −5.1 | −8.2 |
| 6 | 1.7 | −16.8 |
| Hastelloy TM X | −14.4 | −26.0 |

In a similar test in which Alloy No. 1 was exposed at 927° C. for 1008 hours to nitrogen based atmospheres, a weight gain of only 5.6 $g/m^2$ was observed in an atmosphere containing 1 volume % hydrogen balance nitrogen, dew point 3.3° C. In a more agressive nitrogen atmosphere containing 8% hydrogen and 4% CO and having a dew point of 13° C. a weight gain of only 23.2 $g/m^2$ was measured.

All told, the atmosphere tests reported in Tables IV and V and in the proceeding paragraph show that alloys of the invention have the all-around resistance characteristics necessary for successful use in alternating carburizing-oxidizing atmospheres and generally for purposes of intended use as discussed in the introductory portion of this specification. In addition welding tests have shown that the alloys of the invention can be autogenously arc welded or arc welded with filler material such as INCO-WELD TM A welding electrode and INCONEL TM Welding electrode 117 satisfactorily. The alloy of the invention can be used as a coating, for example, a flame sprayed coating or a weld deposit overlay coating on a substrate metal.

The ranges of elemental ingredients in the alloys of the invention are important in that if the nickel or chromium contents are too low oxidation resistance will suffer. If the content of chromium is too high it is possible for phase instability to occur leading to formation of sigma phase and consequent embrittlement upon exposure for long periods to moderately high temperatures e.g., about 820° C. Raising the nickel content of the alloy at the expense of iron increases the costs of the alloy without significant benefit to the alloy characteristics required to achieve the objects of the invention. Aluminum is necessary the amount specified to ensure carburization resistance. If aluminum is too high the alloy becomes difficult to work and it may become unstable, again with the formation of beta phase (NiAI) being possible. Molybdenum and tungsten in the amounts specified tend to increase the strength of the alloy. Excessive amounts of these elements increase the cost, lower the ductility and increase the chances of catastrophic oxidation damage to the alloy.

Those skilled in the art will appreciate that while the present invention has been described in conjunction with specific examples, variations and modifications within the ambit of the appended claims are also included within the contemplation of the present invention.

The embodiments of the invention in which an exclusive property of privilege is claimed are defined as follows:

1. A carburization-resistant alloy useful in carburizing atmospheres having a $Po_2$ of about 1.0E-2 to 1.0E-30 consisting essentially of in weight percent about 50 to about 55% nickel, about 16 to about 22% chromium, about 3 to about 4.5% aluminum, up to about 5% cobalt, up to about 5% molybdenum, up to about 2% tungsten, about 0.03 to about 0.3% carbon, up to about 0.2% rare earth element, balance essentially iron.

2. An alloy as in claim 1 wherein the molybdenum content is a maximum of about 2.5% and the cobalt content is a maximum of about 3%.

3. An alloy as in claim 1 which contains about 0.02% of rare earth element.

4. An alloy as in claim 1 including about 0.06 0.19% carbon about 52 to 54.5% nickel, about 18 to about 19% chromium, about 3.5 to about 3.8% aluminum, up to about 2.5% molybdenum, up to about 3.3% cobalt, about 1.2 to about 1.5% tungsten, up to about 0.02% cerium, balance essentially iron.

5. A hot rolled, annealed alloy as in claim 1.

6. A hot rolled, annealed and aged alloy as in claim 1.

7. A hot rolled, annealed alloy as in claim 4.

8. A hot rolled, annealed and aged alloy as in claim 4.

9. A carburization-resistant alloy object adapted to intermittent exposure to carburizing and oxidizing atmospheres made of an alloy consisting essentially of in weight percent about 50 to about 55% nickel, about 16 to about 22% chromium, about 3 to about 4.5% aluminum, up to about 5% cobalt, up to about 5% molybdenum, up to about 2% tungsten, about 0.03 to about 0.3% carbon, up to about 0.2% rare earth element, balance essentially iron.

10. An alloy object as in claim 9 wherein the molybdenum content of the alloy is a maximum of about 2.5% and the cobalt content is a maximum of about 3%.

11. An alloy object as in claim 9 wherein the alloy includes about 0.02% of rare earth element.

12. An alloy object as in claim 9 wherein the alloy includes about 0.06 to 0.19% carbon about 52 to 54.5% nickel, about 18 to about 19% chromium, about 3.5 to about 3.8% aluminum, up to about 2.5% molybdenum, up to about 3.3% cobalt, about 1.2 to about 1.5% tungsten, up to about 0.02% cerium, balance essentially iron.

13. In a process wherein metal parts making up the process system contact a high temperature, carbonaceous atmosphere having a $P_{O_2}$ of about 1.0E-2 to 1.0E-30 and wherein the process is interrupted by periods of carbon burnout, the improvement comprising employing metal components in contact with said atmosphere made of an alloy consisting essentially in weight percent about 50 to about 55% nickel, about 16 to about 22% chromium, about 3 to about 4.5% aluminum, up to about 5% cobalt, up to about 5% molybdenum, up to about 2% tungsten, about 0.03 to about 0.3% carbon, up to about 0.2% rare earth element, balance essentially iron.

* * * * *